US007872560B2

(12) United States Patent
Hsu

(10) Patent No.: US 7,872,560 B2
(45) Date of Patent: Jan. 18, 2011

(54) INDEPENDENT PLANAR TRANSFORMER

(75) Inventor: Ming-En Hsu, Taoyuan Hsien (TW)

(73) Assignee: ABC Taiwan Electronics Corp., Yangmei, Taoyuan Hsien (TW)

( * ) Notice: Subject to any disclaimer, the term of this patent is extended or adjusted under 35 U.S.C. 154(b) by 974 days.

(21) Appl. No.: 11/723,398

(22) Filed: Mar. 19, 2007

(65) Prior Publication Data

US 2008/0231403 A1 Sep. 25, 2008

(51) Int. Cl.
*H01F 5/00* (2006.01)

(52) U.S. Cl. ..... 336/200

(58) Field of Classification Search ..... 336/65, 336/83, 180–184, 200, 232, 35; 257/531
See application file for complete search history.

(56) References Cited

U.S. PATENT DOCUMENTS 5,952,909 A * 9/1999 Umeno et al. ..... 336/192
6,211,767 B1 * 4/2001 Jitaru ..... 336/200
6,628,531 B2 * 9/2003 Dadafshar ..... 361/836
2004/0257190 A1 * 12/2004 Peck et al. ..... 336/212

* cited by examiner

*Primary Examiner*—Tuyen Nguyen
(74) *Attorney, Agent, or Firm*—Jackson IPG PLLC; Demian K. Jackson

(57) ABSTRACT

A high-efficiency independent planar transformer comprises a pair of up-and-down symmetrical soft ferrite magnetic cores; a primary winding comprising at least one printed circuit board each having a multi-layer structure having at least two layers to form the inductor winding with at least four turns; and two secondary windings comprising at least two planar copper plates or two printed circuit boards. The primary winding and the secondary windings are electrically connected to the main circuit board via terminals. By means of the unique output structure, in the primary winding, two kinds of different output connection structures of the inductor winding can be formed by upward disposing the component side or the solder side of the printed circuit board. In the secondary winding, the inductor winding outputs in series and parallel connections can be accomplished by means of the output terminals or the short-circuit connection with the main circuit board.

3 Claims, 9 Drawing Sheets

INDEPENDENT PLANAR TRANSFORMER

FIELD OF THE INVENTION

The present invention relates to a high-efficiency independent planar transformer that comprises at least one printed circuit board having a multi-layer structure having at least two layers to form equal or unequal numbers of inductor winding turns, at least two planar copper plates or two printed circuit boards to constitute two respective secondary windings, a pair of up-and-down symmetrical soft ferrite magnetic cores, and several electrically connecting terminals. The magnetic device is widely applied to a power supply, and more particularly to a DC/DC converter (shown in FIG. 1).

BACKGROUND OF THE INVENTION

The existing all kinds of digital equipments have a tendency towards higher and higher operation speeds and smaller and smaller sizes for achieving the purposes of saving energy and protecting environment. There are large numbers of DC/DC switching power supplies, which have wide applications, so the required energy and the amount of the power stations can be reduced after performing the energy saving. As a result, the environmental pollution caused by waste water and waste gas exhausted from the power stations can be decreased.

To meet ever-increasing demand for high speed and miniaturization of digital devices, microelectronic circuits are using lower and lower voltage. 5 V and 12 V are no longer dominant power supplies used in microelectronic circuits. 3.3V, 2.5V, 2V, 1.8V, 1.5V, and even 1.2V are becoming standard voltage in many electronic devices. Actually, some next-generation high-speed microprocessors and digital signal processors need 1.0 V as their supply voltage.

Migration to lower supply voltage and size miniaturization is rapidly changing power supply design and packaging technologies. The high switching frequencies together with soft switching and the synchronous rectification technologies help to reduce the losses and size of the power supplies dramatically, thereby further increasing the transformation efficiency.

On the other hand, as the power semiconductors and signal semiconductor devices are getting smaller and smaller, the size reduction of the power magnetic devices, which play critical roles in power supplies, becomes more and more crucial. The use of planar magnetic devices helps to minimize the profile or height of the power supplies. However, the reduction of the sizes of the power transformer and the inductor is the biggest difficulty.

In comparison with the conventional transformer that adopts copper wires as winding coils, the winding coils of the planar transformer is constructed of double-layer or multi-layer printed circuit board or pre-molded planar copper plate. In addition, the planar transformer can be realized upon the successful development of the planar magnetic cores. The planar transformer has significantly increased power density and significantly decreased volume. Accordingly, the volume and thickness of the planar transformer are reduced respectively to only 20 percent and 40 percent of that of the conventional transformer.

The conventional transformer is formed by winding the circular copper wires on the ferrite magnetic core to form winding coil. Therefore, the copper wires can not be fully utilized because of the generation of skin effect, which is especially apparent in high-frequency condition.

When high-frequency electric current flows through a conductor, the change of electric current causes the magnetic field inside and outside the conductor to be changed. According to the electromagnetic induction law, a high-frequency magnetic field creates an induced electromotive force in the conductor on two planes along its longitudinal direction. This induced electromotive force generates an eddy current in the conductor along its longitudinal direction to prevent the magnetic flux from change. The current density of the main electric current and the eddy current is a maximum at the outer edge of the conductor and decreases exponentially towards the center of the conductor. This phenomenon is known as the skin effect. In such a condition, the current-carry area is smaller than the entire conductor area, causing the AC impedance to be larger than DC impedance.

In the planar transformer, the winding is a flat conductor formed by plating copper on the printed circuit board or using the copper plate directly. Although the electric current is focused on the outer surface layer due to the skin effect, the electric current still flow through the entire flat conducting wire for the planar transformer. In comparison with the cylindrical conducting wire, the planar transformer has higher transformation efficiency and power density.

There are examples of "open frame" power converters that rely upon a single mother board technique to create the complete converter including two or more magnetic devices. These magnetic devices that have this configuration are called as embedded planar transformers. Examples include C&D WPA series and Synqor PowerQor series. In these converters, a single multilayer printed circuit board forms the "main circuit board", which contains primary and secondary windings for transformer. However, this technique requires a large, expensive multilayer printed circuit board such as larger than twelve layers. The heat generated in the multilayer power windings is delivered to temperature sensitive control circuit components, causing the wrong action. Also, magnetic properties are difficult to test; the magnetic device is an integral part of the converter product. Defects in the printed circuit board windings can result in expensive scrap of the entire converter. Any changes on the transformer turns ratio due to the output voltage requirement require the multi-layer printed circuit board to be modified, which results in high cost and high printed circuit board inventory for same platform power supplies with different output voltages.

SUMMARY OF THE INVENTION

In the magnetic device of the present invention, the winding of the planar transformer is not formed on the main circuit board, and it is independent of the main circuit board. Therefore, it is more flexible and changeable than the embedded planar transformer in the practical application. In addition, the present invention can reduce the cost of material effectively.

In the magnetic device of the present invention, the primary winding has a geometric configuration so the DC loss can be minimized. In addition, the primary winding and the secondary windings are stacked in an interlaced manner so the AC loss can be also minimized. Therefore, the transformation efficiency of the transformer can be increased, thereby achieving the effect of saving power.

BRIEF DESCRIPTION OF THE DRAWINGS

These and other features, aspects and advantages of the present invention will become better understood with regard to the following description, appended claims, and accompanying drawings, wherein:

DETAILED DESCRIPTION OF THE PREFERRED EMBODIMENT

Figure 1:
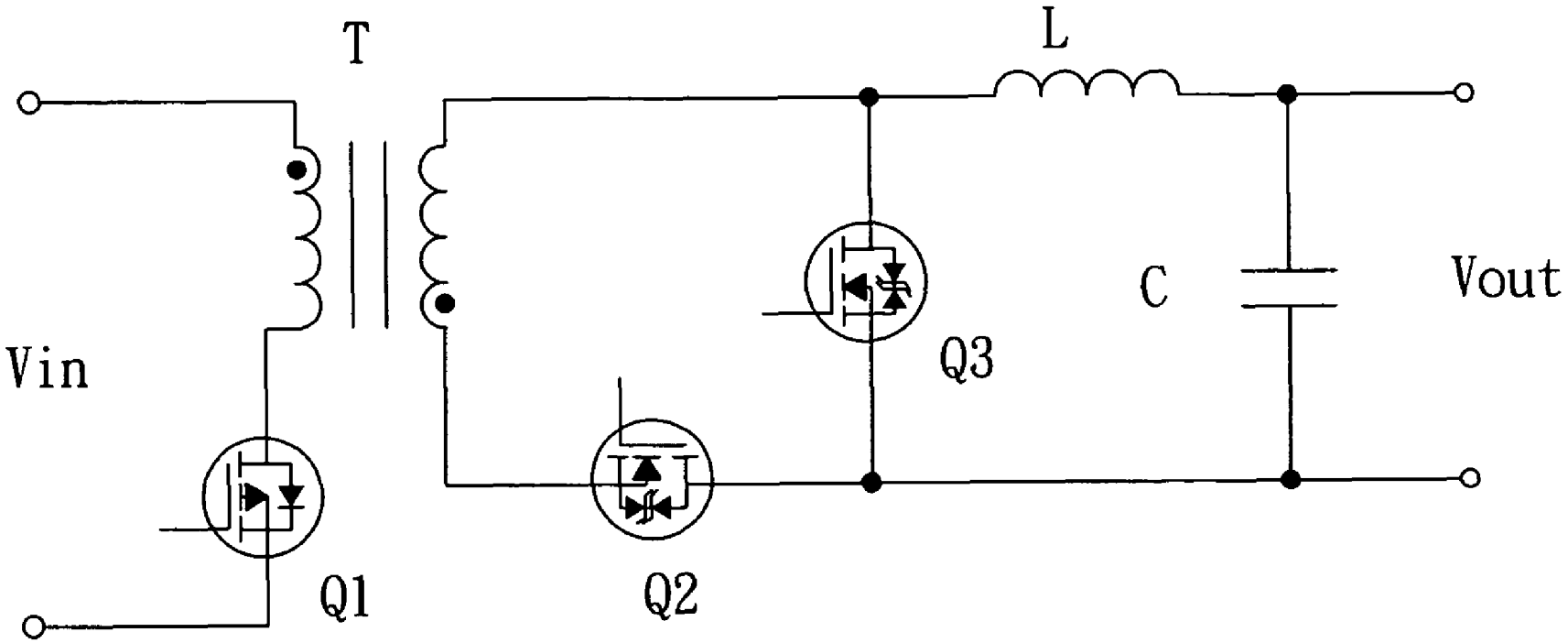
FIG. 1 is a schematic diagram of prior art DC/DC converter.
Figure 2:
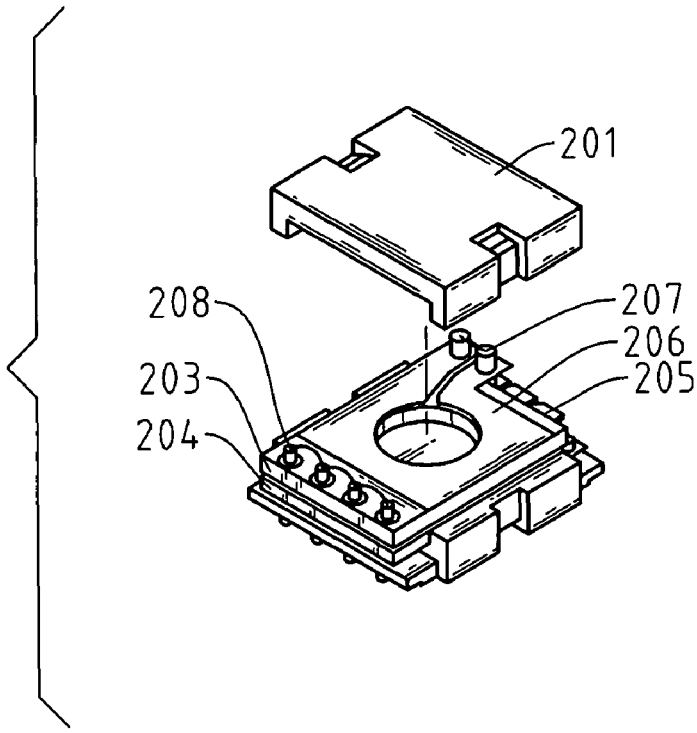
FIG. 2 is an elevational decomposed diagram showing the magnetic device of the present invention.
Figure 3:
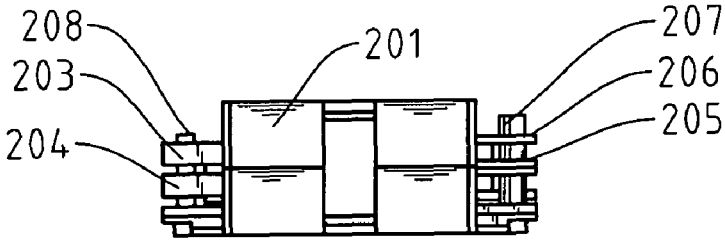
FIG. 3 is a front plan view showing the magnetic device of the present invention.
Figure 4:
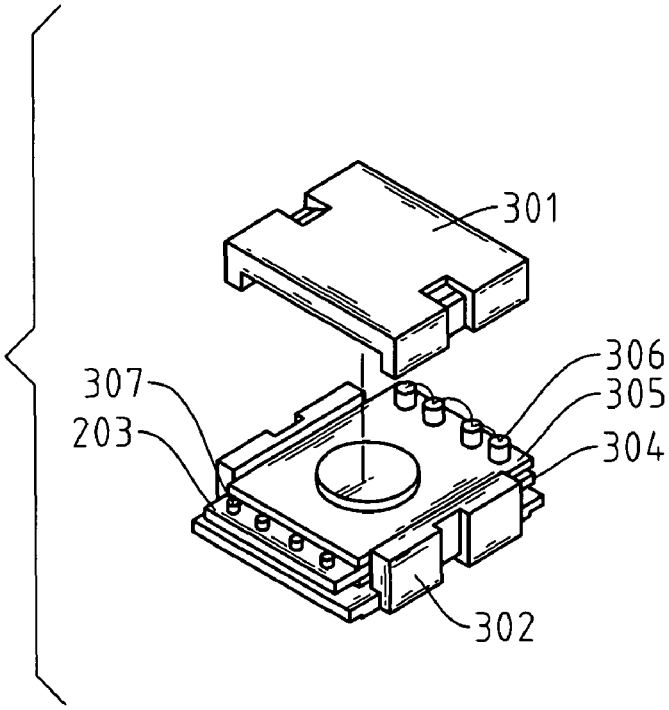
FIG. 4 is an elevational decomposed diagram showing the magnetic device of another preferred embodiment of the present invention.
Figure 5:
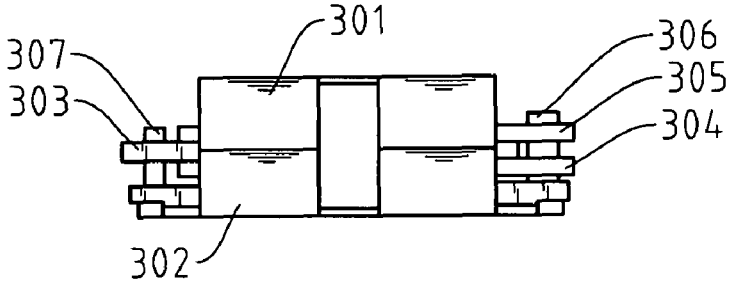
FIG. 5 is a front plan view showing the magnetic device of another preferred embodiment of the present invention.

Referring to FIGS. 2 through 5, there is shown an independent planar transformer, which comprises the devices described below.

A pair of up-and-down symmetrical ER-type or RM-type soft ferrite magnetic cores (201, 202 or 301, 302).

At least one printed circuit board (203, 204 or 303) capable of forming different numbers of inductor winding turns to constitute a primary winding of the planar transformer. In other words, the primary winding comprises at least one printed circuit board (203, 204 or 303), and every printed circuit board (203, 204 or 303) has a multi-layer structure having at least two layers to form the inductor winding with at least four turns.

Two secondary windings comprise at least two planar copper plates (205, 206) or two printed circuit boards (304, 305). Every planar copper plate (205, 206) constitutes one inductor winding turn. Alternatively, the printed circuit boards (304, 305) each have a multi-layer structure having at least two layers to form the inductor winding with at least one turn. In addition, these two printed circuit boards (304, 305) that constitute the secondary windings have the same number of inductor winding turns.

The primary winding and the secondary windings of the planar transformer are electrically connected to a main circuit board via terminals (207, 208 or 306, 307). Besides, the magnetic device and the main circuit board are electrically connected via output terminals, and these two windings can be connected to each other in series or in parallel by the output terminals or the short-circuit connection with the main circuit board.

The magnetic device and the main circuit board are electrically connected via the output terminals.

In the above-mentioned magnetic device, the primary winding and the secondary winding, the primary winding and the primary winding, the secondary winding and the secondary winding of the transformer are respectively electrically isolated from each other by one or more insulating layers.

In the above-mentioned magnetic device, these two planar copper plates (205, 206) or the printed circuit boards (304, 305) that constitute the secondary windings are stacked together with the printed circuit board (203, 204 or 303) that constitutes the primary winding in a sandwich configuration.

In the above-mentioned magnetic device, every printed circuit board (203, 204, 303, 304 and 305) comprises a multi-layer structure having at least two layers, wherein every layer can constitute one or more inductor winding turns.

In the above-mentioned magnetic device, the independent planar transformer is a part of a DC/DC converter.

Figure 6:
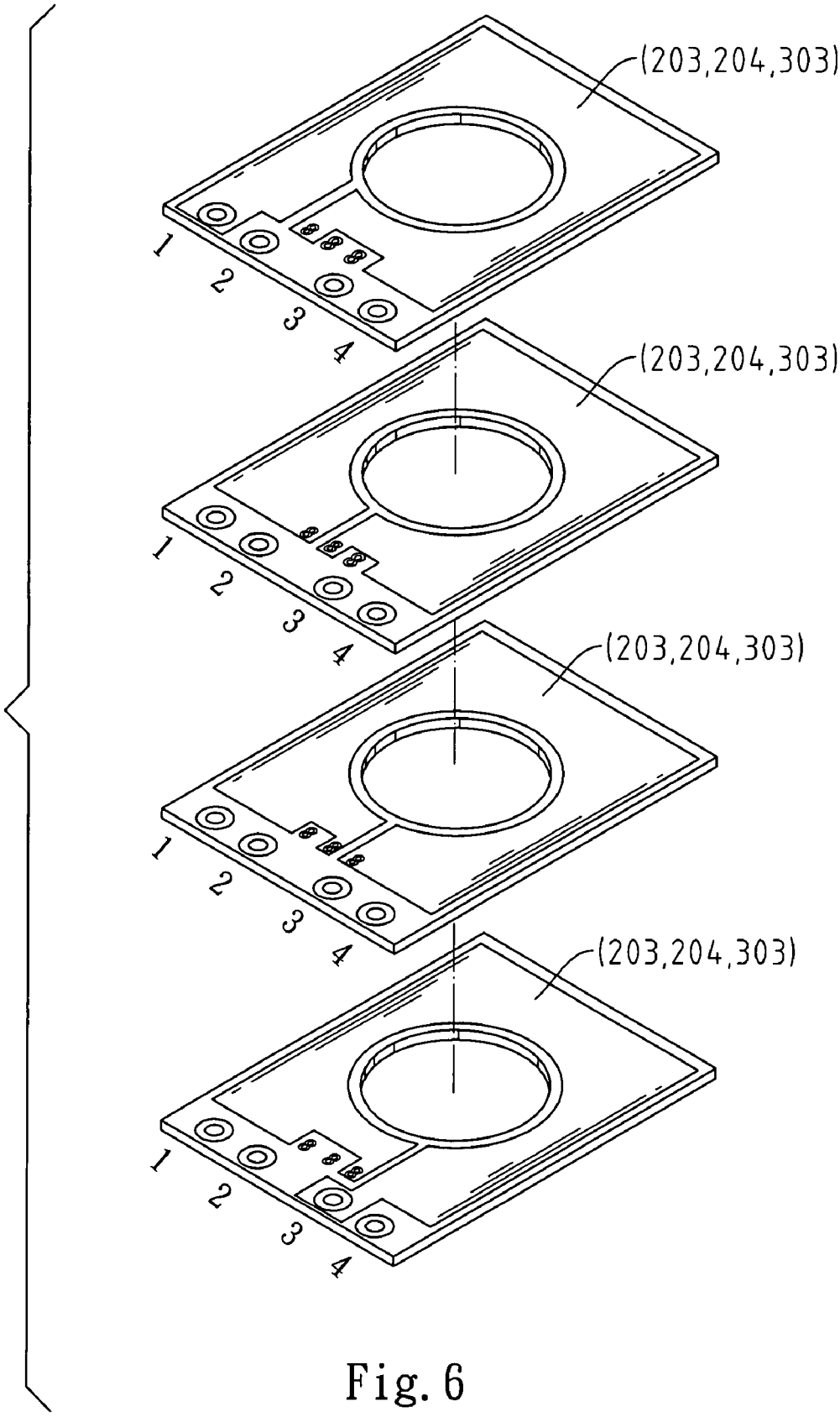
FIG. 6 is a schematic diagram showing the printed circuit board that has four inductor winding turns constituted by four internal layers in accordance with the present invention.
Figure 7:
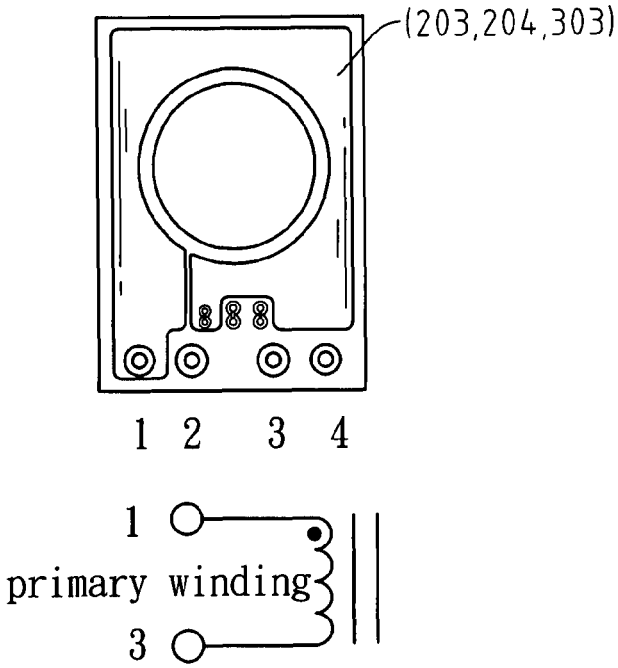
FIG. 7 is a schematic plan diagram showing the output connection structure and the upwardly disposed component side of the printed circuit board in accordance with the present invention.
Figure 8:
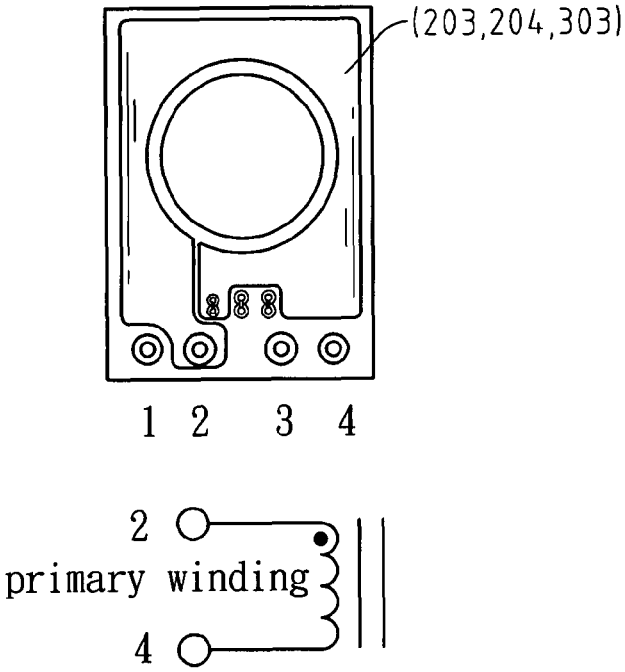
FIG. 8 is a schematic plan diagram showing the output connection structure and the upwardly disposed solder side of the printed circuit board in accordance with the present invention.

In the magnetic device of the present invention, the primary inductor winding is constituted by the printed circuit board (203, 204 or 303). Referring to FIG. 6, there is shown a schematic diagram depicting the printed circuit board that has four inductor winding turns constituted by four internal layers. Because the unique output structure for the inductor winding is employed, the winding connection structure as shown in FIG. 7 is formed when the component side of the printed circuit board is upwardly disposed. Besides, the winding connection structure as shown in FIG. 8 is formed when the solder side of the printed circuit board is upwardly disposed.

Figure 9:
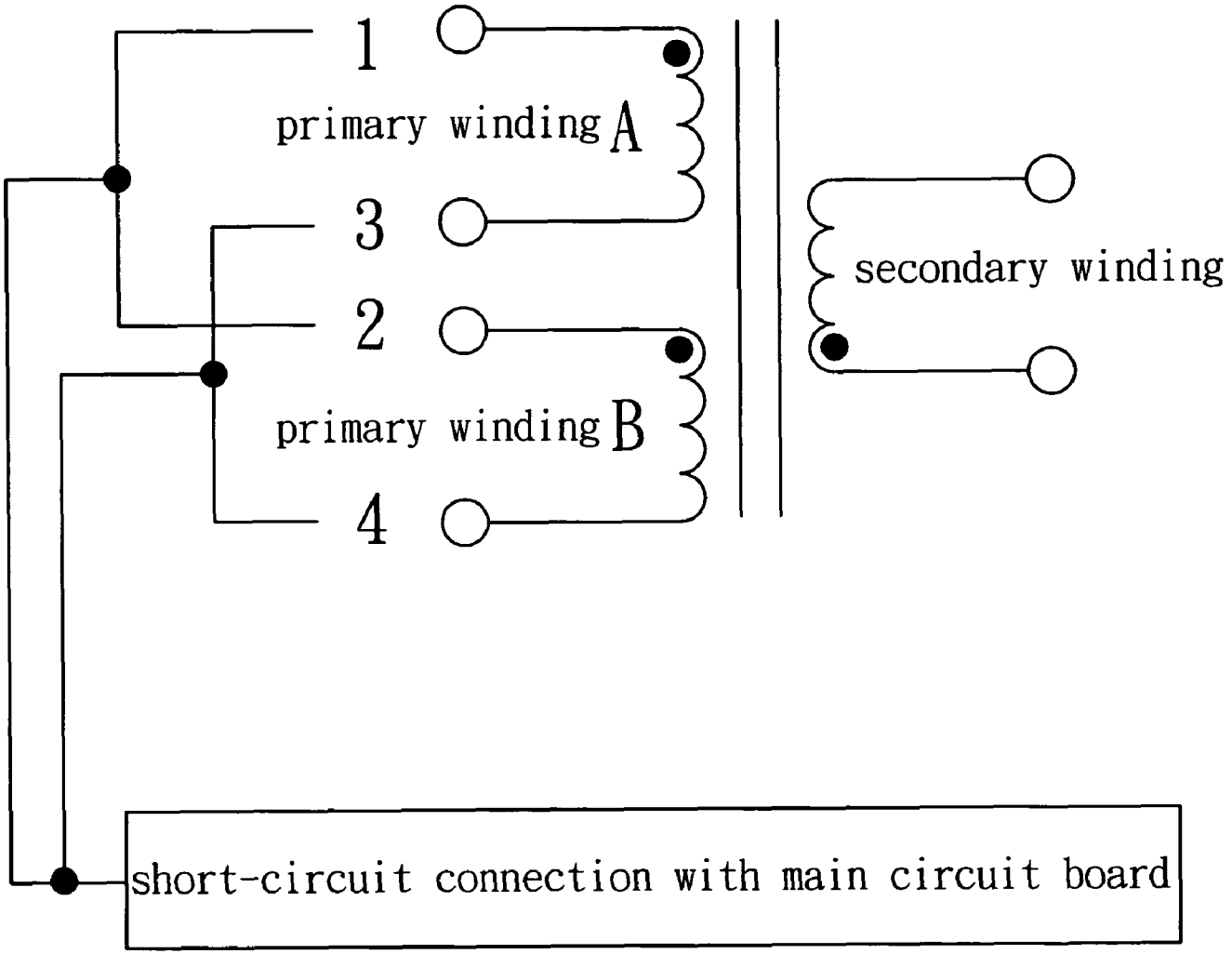
FIG. 9 is a schematic diagram showing the primary winding coupled to the output connection structure in accordance with the present invention.
Figure 10:
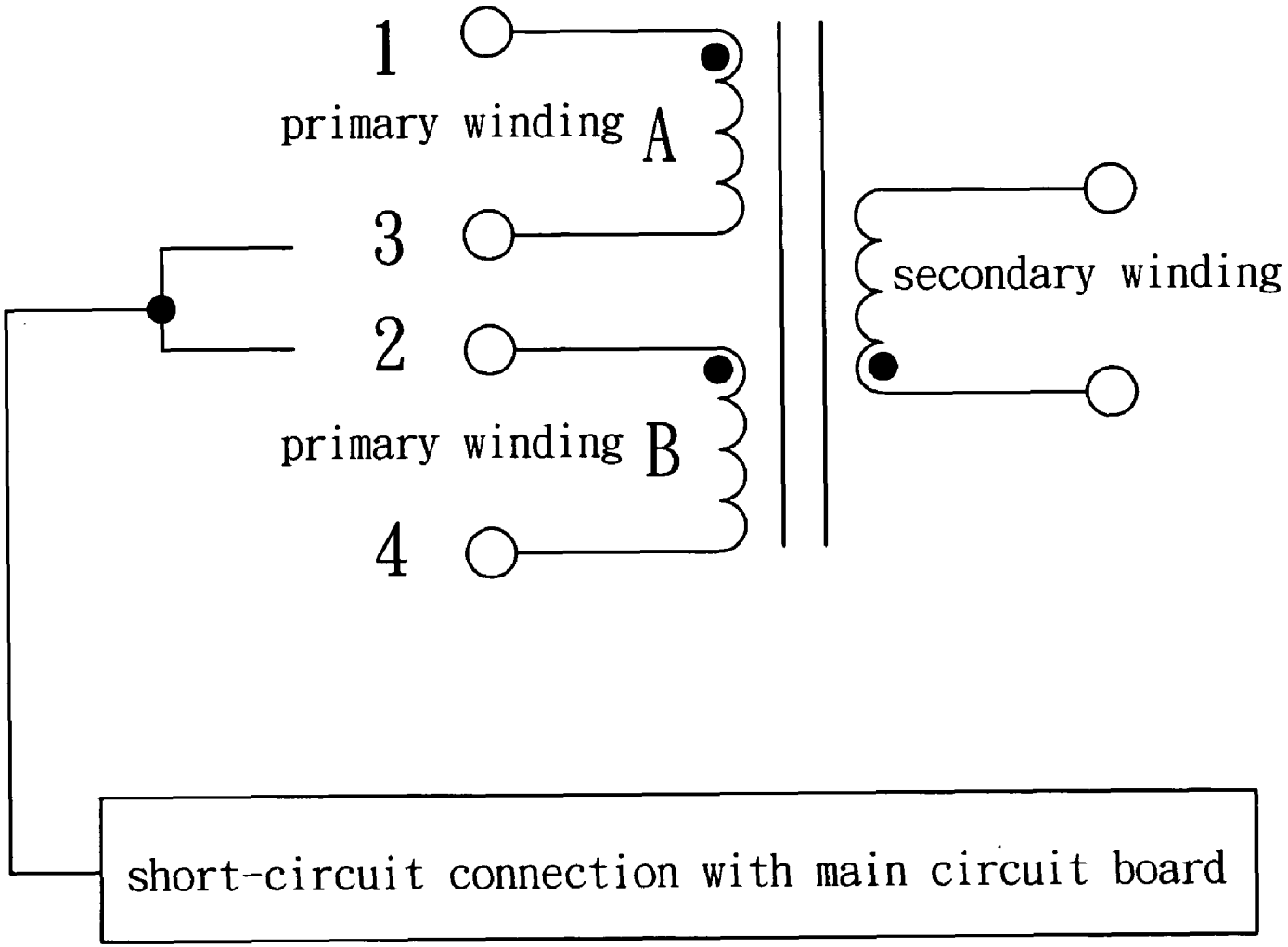
FIG. 10 is another schematic diagram showing the primary winding coupled to the output connection structure in accordance with the present invention.

Referring to FIG. 2 through FIG. 12, in the primary winding, which is constituted by at least one printed circuit board (203, 204 or 303), when the component side (shown in FIG. 7) or the solder side (shown in FIG. 8) of the same printed circuit board (203, 204 or 303) is upwardly disposed, different output connection structures of the inductor winding can be formed, as shown in FIG. 9 and FIG. 10. Furthermore, when two printed circuit boards (203, 204 or 303) that have the same number of inductor winding turns are stacked in sequence to constitute the primary windings by upwardly disposing their respective component sides, these two primary windings can be connected to each other in parallel via the terminals on the magnetic device directly. When two printed circuit boards (203, 204 or 303) that have the same number of inductor winding turns are stacked with the respective component sides placed facing each other to form the primary windings, the magnetic device and the main circuit board are electrically connected via the terminals. In addition, these two windings can be connected to each other in series or in parallel by means of the output terminals or the short-circuit connection with the main circuit board, as shown in FIGS. 9 and 10.

When two printed circuit boards (203, 204 or 303) that have different numbers of inductor winding turns are stacked with respective solder sides placed facing each other to form the primary windings, these two windings can be connected to each other in series by electrically connecting the magnetic device and the main circuit board via the terminals, as shown in FIG. 10.

Figure 11:
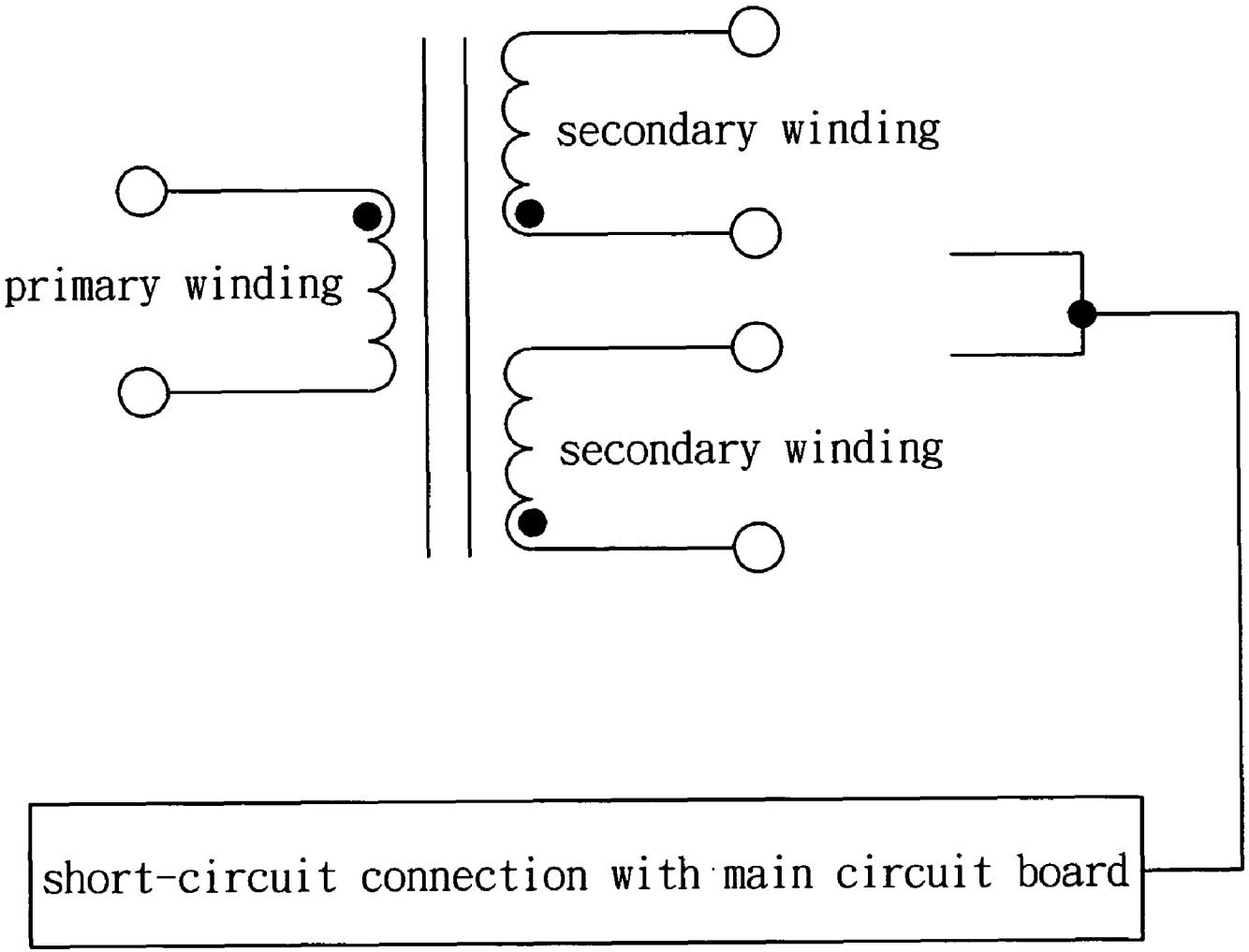
FIG. 11 is a schematic diagram showing the secondary winding coupled to the output connection structure in accordance with the present invention.
Figure 12:
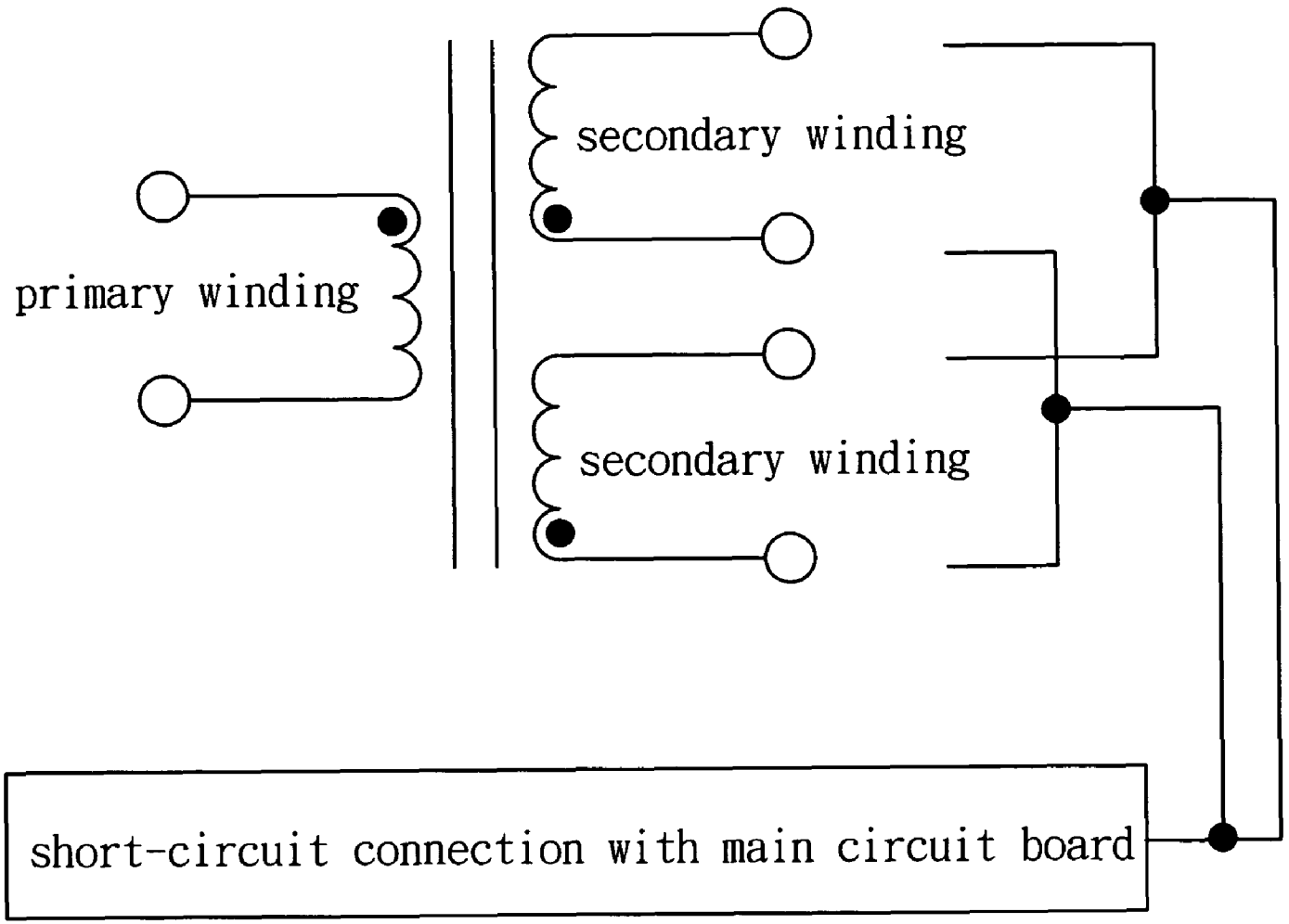
FIG. 12 is another schematic diagram showing the secondary winding coupled to the output connection structure in accordance with the present invention.

When at least two planar copper plates (205, 206) or two printed circuit boards (304, 305) that have the same number of inductor winding turns are stacked to form the secondary windings, the magnetic device and the main circuit board can be electrically connected via the terminals (207, 208 or 306, 307). In addition, these two windings can be connected to each other in series or in parallel by short-circuit connection with the main circuit board, as shown in FIGS. 11 and 12.

Because the unique output structure for the inductor winding is employed, in the primary winding, two different kinds of output connection structures of the inductor winding can be formed by upward disposing different sides (the component side and the solder side as shown in FIG. 7 and FIG. 8) of the same printed circuit board (203, 204 or 303). In the secondary winding, the inductor winding output in series connection and the inductor winding output in parallel connection can be accomplished by means of the output terminals or the short-circuit connection with the main circuit board.

The advantage of it consists in the ability to provide much more winding combinations to satisfy requirements of series products that require different input and output voltages so at least a half of the cost for producing the printed circuit board can be reduced, thereby reducing the production cost significantly.

What the invention claimed is:

1. A magnetic device, comprising:

one or more pairs of up-and-down symmetrical ER-type or RM-type soft ferrite magnetic cores;

at least one printed circuit board capable of forming different numbers of inductor winding turns, said printed circuit board constituting a primary winding of a planar transformer;

at least two planar copper plates or two printed circuit boards to constitute two respective secondary windings of said planar transformer; and a plurality of output terminals for electrically connecting said primary winding of said planar transformer with said secondary windings of said planar transformer, wherein said magnetic device and a main circuit board are electrically connected by said output terminals, wherein different winding output connection structures can be formed by upward disposing a component side or a solder side of one piece of said at least one printed circuit board that constitutes said primary winding, wherein when two pieces of said at least one printed circuit boards that have the same number of inductor winding turns are stacked in sequence to constitute two primary windings by upwardly disposing their respective component sides, said magnetic device and said main circuit board can be electrically connected via said output terminals, and said two primary windings can be connected to each other in parallel by means of terminals on said magnetic device directly.

2. A magnetic device, comprising:

one or more pairs of up-and-down symmetrical ER-type or RM-type soft ferrite magnetic cores;

at least one printed circuit board capable of forming different numbers of inductor winding turns, said printed circuit board constituting a primary winding of a planar transformer;

at least two planar copper plates or two printed circuit boards to constitute two respective secondary windings of said planar transformer; and a plurality of output terminals for electrically connecting said primary winding of said planar transformer with said secondary windings of said planar transformer, wherein said magnetic device and a main circuit board are electrically connected by said output terminals, wherein different winding output connection structures can be formed by upward disposing a component side or a solder side of one piece of said at least one printed circuit board that constitutes said primary winding, wherein when two printed circuit boards that have the same number of inductor winding turns are stacked with respective component sides placed facing each other to form two primary windings, said magnetic device and said main circuit board are electrically connected via terminals, and said two primary windings can be connected to each other in series or in parallel by means of short-circuit connection with said main circuit board.

3. A magnetic device, comprising:

one or more pairs of up-and-down symmetrical ER-type or RM-type soft ferrite magnetic cores;

at least one printed circuit board capable of forming different numbers of inductor winding turns, said printed circuit board constituting a primary winding of a planar transformer;

at least two planar copper plates or two printed circuit boards to constitute two respective secondary windings of said planar transformer; and a plurality of output terminals for electrically connecting said primary winding of said planar transformer with said secondary windings of said planar transformer, wherein said magnetic device and a main circuit board are electrically connected by said output terminals, wherein different winding output connection structures can be formed by upward disposing a component side or a solder side of one piece of said at least one printed circuit board that constitutes said primary winding, wherein when two printed circuit boards that have different numbers of inductor winding turns are stacked with respective component sides placed facing each other to form two primary windings, said magnetic device and said main circuit board are electrically connected via said output terminals, and said two primary windings can be connected to each other in series by means of short-circuit connection with said main circuit board.

* * * * *